US007836963B2

(12) United States Patent
Collins

(10) Patent No.: US 7,836,963 B2
(45) Date of Patent: Nov. 23, 2010

(54) COMPACT SELF CONTAINED REMOVABLE FIREFIGHTING UNIT

(76) Inventor: Jeff Collins, P.O. Box 14, Boerne, TX (US) 78006

( * ) Notice: Subject to any disclaimer, the term of this patent is extended or adjusted under 35 U.S.C. 154(b) by 119 days.

(21) Appl. No.: 11/825,885

(22) Filed: Jul. 10, 2007

(65) Prior Publication Data

US 2009/0014186 A1 Jan. 15, 2009

(51) Int. Cl.

| | |
|---|---|
| ***A62C 35/00*** | (2006.01) |
| ***A62C 27/00*** | (2006.01) |
| ***A62C 11/00*** | (2006.01) |
| ***A62C 3/07*** | (2006.01) |
| ***A62C 3/08*** | (2006.01) |

(52) U.S. Cl. ..... 169/24; 169/13; 169/30; 169/62

(58) Field of Classification Search ..... 169/13, 169/24, 30, 62

See application file for complete search history.

(56) References Cited

U.S. PATENT DOCUMENTS

| | | | | |
|---|---|---|---|---|
| 2,757,958 | A | 8/1956 | Bussey et al. | |
| 3,567,136 | A * | 3/1971 | Garrett | 239/587.2 |
| 3,605,908 | A | 9/1971 | McDonald et al. | |
| 3,840,074 | A * | 10/1974 | Clark | 169/24 |
| 4,593,855 | A * | 6/1986 | Forsyth | 239/74 |
| 4,678,041 | A * | 7/1987 | Staudinger | 169/24 |
| 5,113,946 | A | 5/1992 | Cooper | |
| 5,190,218 | A | 3/1993 | Kayser et al. | |
| 5,573,300 | A | 11/1996 | Simmons | |
| 6,029,750 | A * | 2/2000 | Carrier | 169/52 |
| 6,311,781 | B1 | 11/2001 | Jerke | |
| 6,571,882 | B2 * | 6/2003 | Yen | 169/24 |
| 6,889,877 | B2 | 5/2005 | Bieker | |
| 6,923,285 | B1 * | 8/2005 | Rossow et al. | 180/272 |
| 6,973,975 | B1 * | 12/2005 | Adamson et al. | 169/24 |
| 2004/0003929 | A1 | 1/2004 | Graf | |
| 2004/0050557 | A1 | 3/2004 | Koopmann | |
| 2005/0126631 | A1 | 6/2005 | Gorman, Jr. | |
| 2005/0155993 | A1 | 7/2005 | Bieker | |

* cited by examiner

*Primary Examiner*—Len Tran
*Assistant Examiner*—Ryan Reis
(74) *Attorney, Agent, or Firm*—Charles W. Hanor

(57) ABSTRACT

A system which is sufficiently compact and portable to be moved via skid support platform to a multi-wheel diesel-powered host containing active pump and roll capability with front and rear active hydraulics, such as a Bobcat Toolcat Turbo 5600. The system contains a water tank, generally 150 gallons, as well as built in foam tank. The system is wholly powered by the hydraulic system of the host vehicle powering a hydraulic motor on the system. The system hydraulic motor turns a serpentine belt at sufficient RPM's to power a water pump, air compressor and the compressed air foam system (CAFS) module. Using solely the power provided by the hydraulic motor, water is drawn from the tank, either used alone or mixed with foam at the percentage inputted by the user. Compressed air is added and the air alone, water alone or water/foam mixture is routed via adjustable valve to either the 1 inch firefighters hose or the rigid waterway ending in an adjustable, movable nozzle attached to the cab roof of the host.

19 Claims, 6 Drawing Sheets

COMPACT SELF CONTAINED REMOVABLE FIREFIGHTING UNIT

FIELD OF THE INVENTION

This invention relates to the field of firefighting, or more particularly the field of wildland and brush firefighting in areas requiring specialized, portable off-road equipment to gain access to the involved area. More particularly, this invention provides a compact, self-contained, removable firefighting unit using a water/foam fire fighting system which is able to access areas that traditional larger firefighting vehicles are unable to access.

BACKGROUND OF THE INVENTION

There are many situations when it would be helpful to have a compact, portable firefighting system readily available and able to venture where large, full-scale firefighting vehicles and pick-up trucks are unable to go. This system would be extremely helpful in rural areas where smaller or volunteer fire departments need a system to take water and foam directly to the fire, despite the fire being off-road or in an inaccessible brush or forested area.

This portable, compact system would serve as an adjunct to the fire fighters who typically are required to fight wildland and brush fires on the ground with hand tools which is both labor intensive, costly and dangerous.

The ability to take foam directly to a fire has multiple benefits. The usefulness of foam in firefighting has long been recognized. Foam allows firefighters to blanket an area, retarding combustion or suffocating a fire already present. Additionally, depending on the % concentration of the foam, it is able to "stick" to potential combustibles, including brush and trees.

BRIEF SUMMARY OF THE INVENTION

This invention relates to a multi-functional hydraulically-driven compressed air foam system (CAFS) module built into a system which contains a front remote control nozzle and rear hose reel for wildland and brush firefighting in areas typically difficult to reach with conventional wildland and brush fire apparatus.

The current invention is designed for attachment via removable skid support platform to a multi-wheel diesel-powered host containing active pump and roll capability with front and rear active hydraulics, such as a Bobcat Toolcat Turbo 5600.

The primary object of this system is to allow a one- or two-man firefighting team to easily gain access to areas of difficult terrain for safe and efficient firefighting. The system requires minimal manpower and equipment to work these difficult areas.

The current invention is built on a removable skid support platform that contains a front-mounted, remote control nozzle; rigid water supply conduit and support mounted above the unit and over the host's cab; equipment storage boxes; water tank with a built-in foam cell; a hose reel and hose; and a CAFS module containing a water pump, hydraulic motor and rotary screw air compressor. One of the advantages of this design is that a separate combustion engine is not required to power the water pump, air compressor or CAFS unit as everything is driven by the hydraulic motor. This fact helps keep the system compact and light enough for use on a multi-wheel diesel-powered host containing active pump and roll capability with front and rear active hydraulics, such as a Bobcat Toolcat Turbo 5600. Additionally, the lack of combustion engines adds to the safety of the system as a combustible fluid such as gasoline is not required to power the unit separate and apart from the diesel motor which powers the hydraulic system on the host vehicle.

The current invention's remote control nozzle is controlled by a hand-held unit typically known as a "joy stick" inside the host's cab. The joy stick is either wired to the invention's electronic communicator or controlled by radio-operated wireless technology. Liquid or foam is supplied to the front remote control nozzle through a series of rigid water supply conduits and supports mounted above the system and the host's cab.

Although the host's diesel engine provides power, power could also be provided by any other number of sources including but not limited to fuel battery packs, natural or propane gas, electric or gasoline motor, or any combination of these sources if necessary or desired by the end user.

Water may be drawn from the attached tank, generally 150 gallons, or from another external source such as a swimming pool, lake, stream or river. The water, foam or water/foam may be discharged via either the attached 150 ft. forestry hose or remote control cab mounted nozzle.

PRIOR ART

Unlike the prior art, the current invention is on a hydraulically-driven host, which does not require an air compressor to provide brakes for the host, leaving the air compressor to provide 100% capacity toward fire protection or other uses, such as operating firefighting, rescue tools, or equipment.

A disadvantage of the Adamson system described in prior art U.S. Pat. No. 6,973,975 to Anderson et al. is that the prior art's system's pump and air compressor are each powered by separate, auxiliary gas or diesel engines. The advantage of the hydraulically powered CAFS module in the current invention is the elimination of a separate auxiliary motor. In the current invention, the air compressor and pump are driven by a single hydraulic motor that is powered by the host's motor.

Another distinct advantage of the current invention is the significant difference in weight of the entire unit, due to the use of the hydraulic motor rather than the separate auxiliary motors of the prior art. Typical gas or diesel motors such as those used in the prior art take away a significant amount of usable gross vehicle weight (GVW). The hydraulic motor in the current invention requires only a fraction of the GVW, which allows the user to carry more water, foam or firefighting equipment.

Unlike the Adamson prior art, the current invention also contains a rigid preplumbed waterway mounted above the unit and the host's cab which supplies water or foam to the front remote control nozzle. In addition, the nozzle is operated from the protection of the host's controlled-temperature cab, eliminating the need for the crew to move outside of the host cab once the firefighting efforts begin. The hose also can be operated from inside of the host cab by one of the crew members rather than on foot, as with most other systems.

DESCRIPTION OF THE DRAWINGS

FIG. 4 illustrates the driver's side perspective of the CAFS module in the current invention showing placement of the individual components that make up the module.

DETAILED DESCRIPTION OF THE INVENTION

Figure 1:
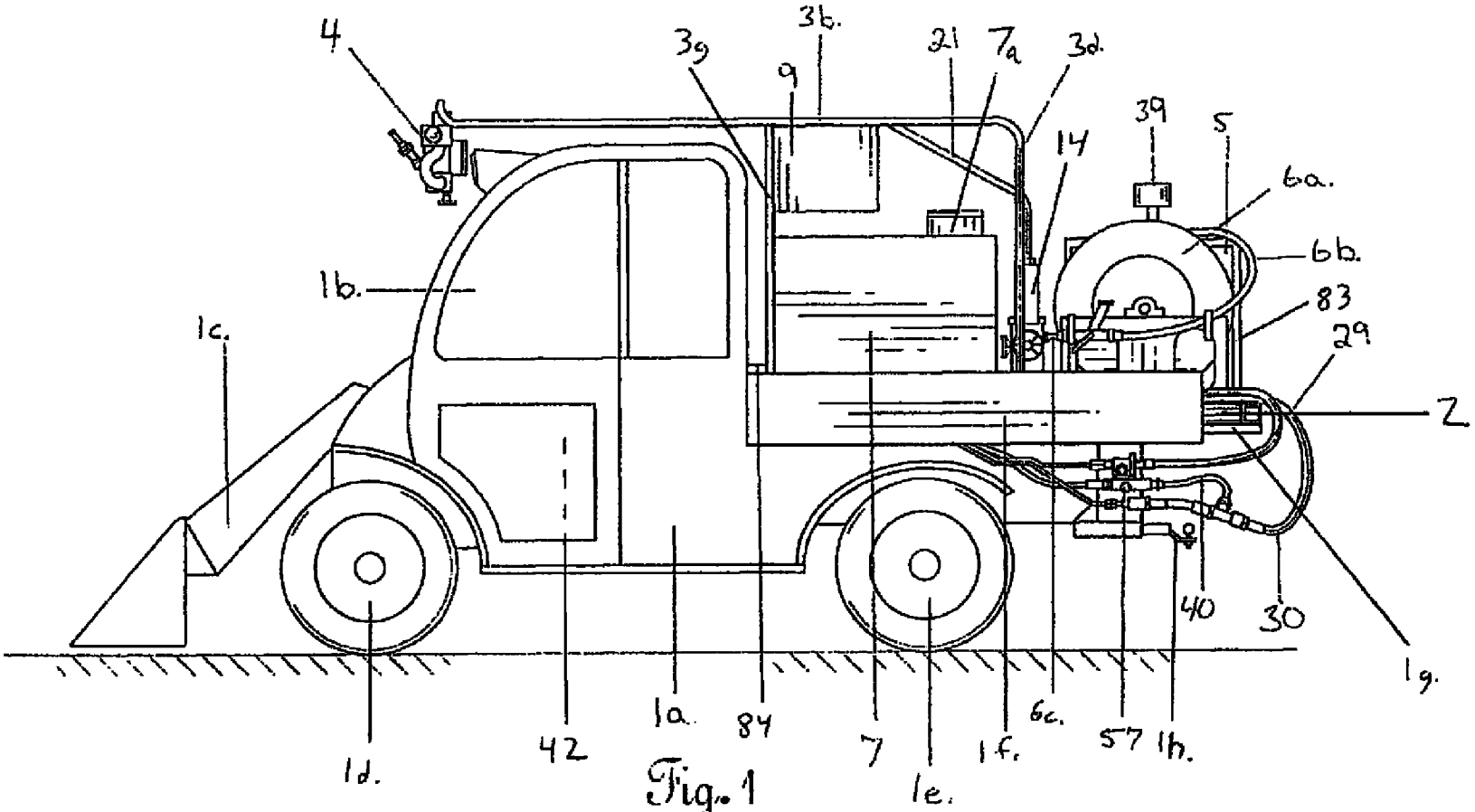
FIG. 1 illustrates the driver's side perspective of the current invention mounted on a typical host with a multiuse attachment on the front of host.

Referring now to FIG. 1, the illustration is the driver's side perspective of the system on a compact host vehicle 1. The compact host vehicle 1 is typically a multipurpose compact, chassis-framed vehicle that can be easily maneuvered in tight spaces that is usually equipped with a hydraulically-operated bucket attachment 1*c* located in front of the front wheels 1*d*, trailer hitch 1*h* behind the rear wheels 1*e* and hydraulic connections under the bed 1*f* on the driver's side. The compressed air foam system CAFS unit 5 stabilized by a steel frame 83, water tank 7, and metal reel 6*a* are attached to a skid support platform 2 comprised of aluminum tubing and sheets. The skid support platform 2, which is distinct from and not integral with the frame of the host vehicle 1, is operable to be removably mounted on the rear section of the host vehicle. More particularly, the skid support platform 2 fits within bed 1*f*, spanning the width of the bed 1*f* and extending onto the tailgate 1*g*. The easily removable skid support platform 2 is mounted onto the bed 1*f* and tailgate 1*g* of host 1 with two steel bolts 64 (visible on FIG. 5) on the left rear and two steel bolts 64 on the right rear of the skid support platform. The skid support platform 2 is further attached to the bed 1*f* of host 1 by inserting the front of skid support platform 2 proximal to the drivers cab 1*b* under a lip 84 bolted to bed 1*f* of the host vehicle with bolts 64.

The polyurethane water tank 7, mounted to skid support platform 2, is shown immediately behind the driver's cab 1*b* of host vehicle 1 and spans the width of the bed 1*f*. The water tank refill conduit 7*a* is located on the rear portion of the water tank 7 on the driver's side. This conduit allows the water tank to be refilled by hose. A personal protective equipment storage box 9 spans the width of the water tank and is mounted over the water tank 7. A large metal hose reel 6*a* apparatus is mounted on the skid platform 2 located on the driver's side behind the water tank 7 extending to the rear of host 1 and may include 150 feet of forestry hose 6*b* with nozzle attached 6*c*. The CAFS unit 5 and its steel frame 83, is mounted on the passenger side of host 1 next to the metal hose reel 6*a*.

DETAILED DESCRIPTION OF THE INVENTION

Also mounted on the skid support platform 2 are steel tubular supports 3 that support an adjustable remote control nozzle 4 located above the driver's cab 1*b*. The tubular supports 3 are mounted to the skid support platform 2 at the front driver's side corner of the bed 1*f* just behind the lip 84 by vertical support 3*g*, and on the driver's side in the middle of the bed 1*f* by vertical support 3*d*. Each tubular support has a counterpart on the passenger's side (not shown) with 3*h* in the front and 3*e* in the middle of the bed If. Mounted parallel to the ground along the driver's side, tubular support 3*b* extends over the driver's cab 1*b* and is welded to the supports 3*g* and 3*d*. On the passenger side, support 3*a* is welded to vertical support columns 3*h* and 3*e* (not shown) and extends across the passenger's side cab. Tubular support 3*c* is located across and in front of the cab 1 *b* with nozzle 4 mounted in the center. The nozzle 4 is controlled by a trigger controlled wired joystick 42 mounted in the operator cab 1*b*.

The host 1 hydraulic hookup 57 is located on the driver's side under the bed 1*f*. The flexible hydraulic hose 29 transports hydraulic oil from the host 1 to the hydraulic motor 11 (shown in FIG. 4) and is then returned to the hydraulic hookup 57 via flexible hydraulic hose 30. Additionally, a flexible auxiliary return hose 40 connects flexible hydraulic return hose 30 to hydraulic hookup 57. All connections to the hydraulic hookup 57 are through quick connect couplings.

Figure 2:
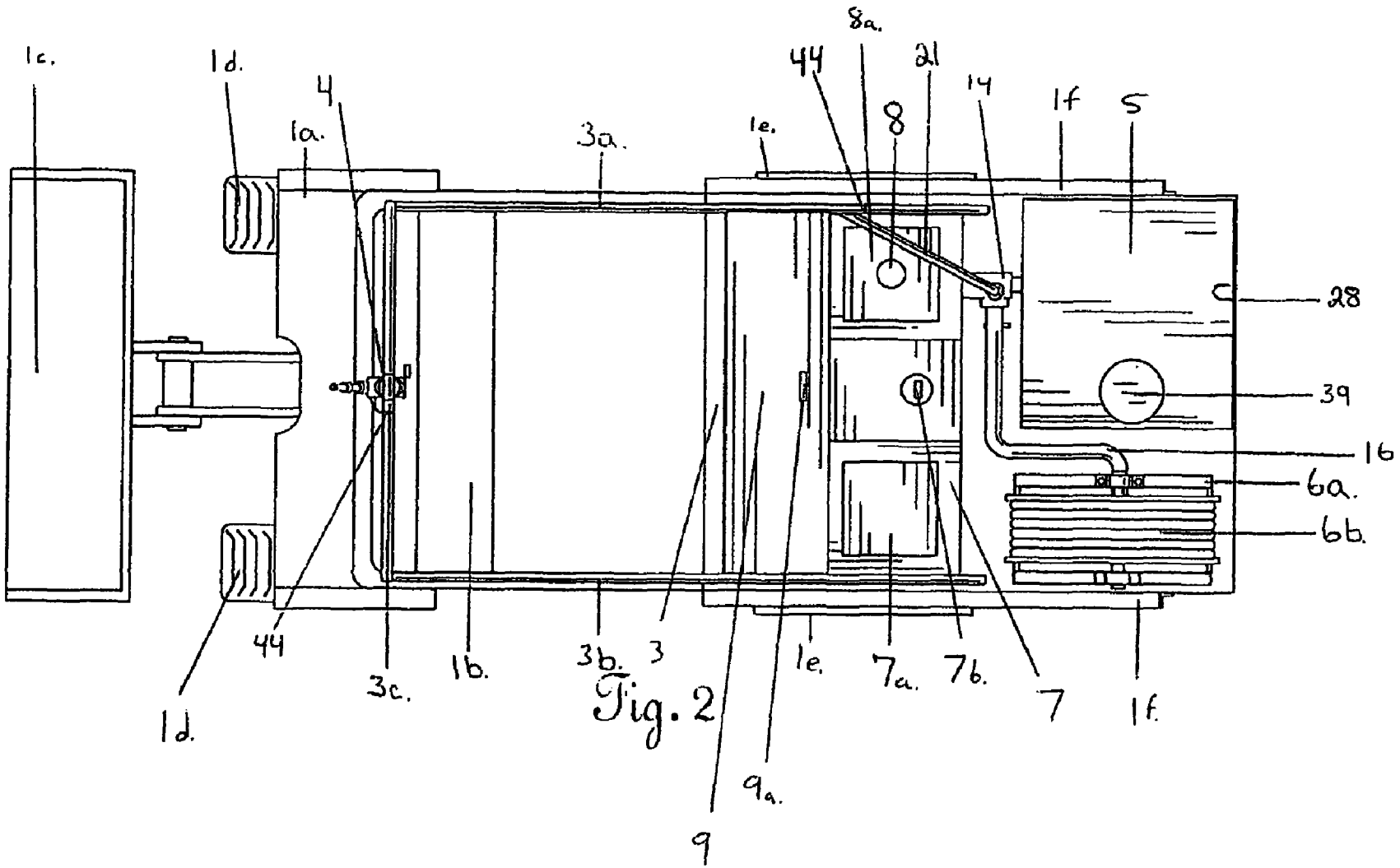
FIG. 2 illustrates the view from the top of the current invention showing the placement of the system components, rigid pre-plumbed waterway and remote-control nozzle in relation to the host with a multiuse attachment on the front of host.

Turning now to FIG. 2 of the CAFS unit 5, there is shown the adjustable remote control nozzle 4 attached to the rigid water supply conduit and support 3*c* which provides either water or a water/foam mixture to the nozzle. Supports 3*c* and 3*a* serve as conduits for the water/foam mixture to reach the remote controlled nozzle 4. Support 3*c* consists of multiple parts with segment 3*c* spanning the width of cab 1 *b* and located above it. Support 3*c* is connected on the driver side by support 3*b* that runs along top of the driver side to approximately the middle of the bed 1*f* (shown in FIG. 1). Support conduit 3*c* is connected on the passenger side through support conduit 3*b* that runs the length of the passenger side to approximately the middle of bed 1*f*. The joint between supports 3*c* and 3*b* is formed by utilizing two 90 degree curved elbow pieces. One curved elbow is joined to support 3*b* with the open end facing up. The second curved elbow piece connects to the first elbow and connects with support 3*c*. The result is an upward 90 degree curve that adds to structural stability of support 3*c*. The joint between 3*c* and 3*a* is formed in the same manner. Steel tubular support 3*i* runs parallel to support conduit 3*c* and is located directly behind the cab 1 *b*. A rigid "T" joint is formed by supports 3*i*, 3*b* and 3*g* on the driver's side, and another "T" joint is formed on the passenger side between supports 3*i*, 3*a*, and 3*h*. Flexible water/foam hose 21 is attached to pump discharge pipe 14 through a clamp and is also attached to support conduit 3*a* through a clamp. There are two welded steel caps 44 which close support 3*a* to prevent the backflow of water or foam. There is one cap 44 immediately posterior to the joint of support 3*a* and flexible water/foam hose. There is another cap inside support 3*c* immediately past the remote controlled nozzle 4. The result is a water/foam conduit allowing water/foam to flow from the juncture of support 3*a* and flexible water/foam hose 21 to the remote controlled nozzle 4.

A personal protective equipment storage box 9 with latch 9*a* is mounted above the water tank 7 and is directly behind the cab 1*b*. A lid 7*a* that can be lifted manually is located on the driver's side on top of the water tank 7 that can be used to fill the water tank 7 with water. In the middle of the water tank 7 is a removable panel with a latch 7*b*. The foam tank 8 is formed on the interior passenger side of the water tank 7 and has a refill conduit 8*a* for the foam tank located adjacent to lid 7*a*. The steel hose reel apparatus 6*a* is attached to the skid support platform system 2 on the rear driver side immediately proximal to the CAFS unit 5. The CAFS unit 5 is immediately adjacent to the hose reel 6*a* and is to the rear of the system, attached to the skid support platform 2 on the passenger side of the system. The flexible hose reel discharge line 16 is connected to the steel reel assembly 6*a* and runs between the steel hose reel 6*a* and the CAFS unit 5 before curving 90 degrees behind the CAFS unit 5 and between the water tank 7.

The flexible hose reel discharge line 16 provides either water or a water/foam mix to the hose 6*b*.

Figure 3:
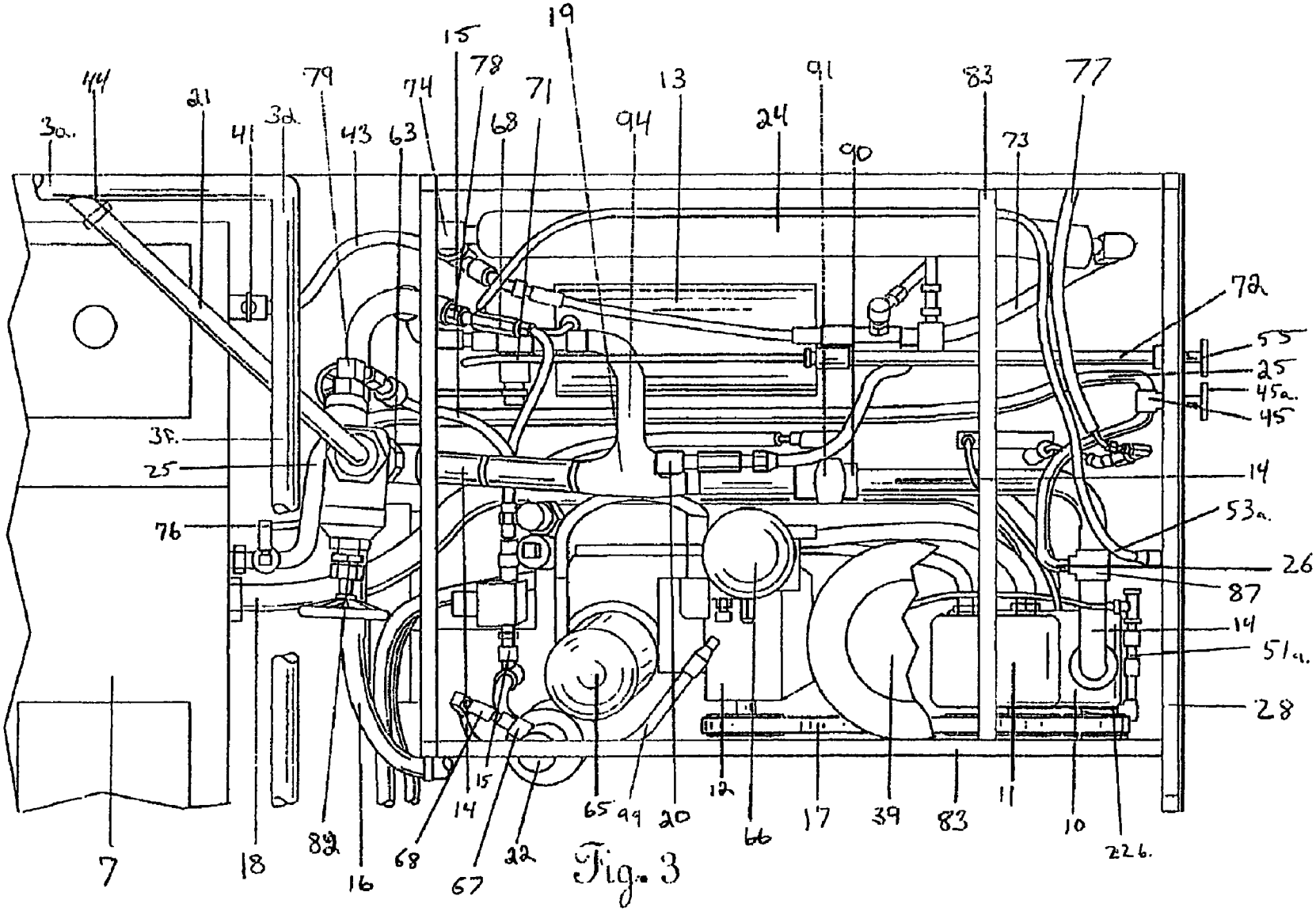
FIG. 3 illustrates a view from the top of the CAFS module in the current invention showing placement of the individual components that make up the module.
Figure 1:
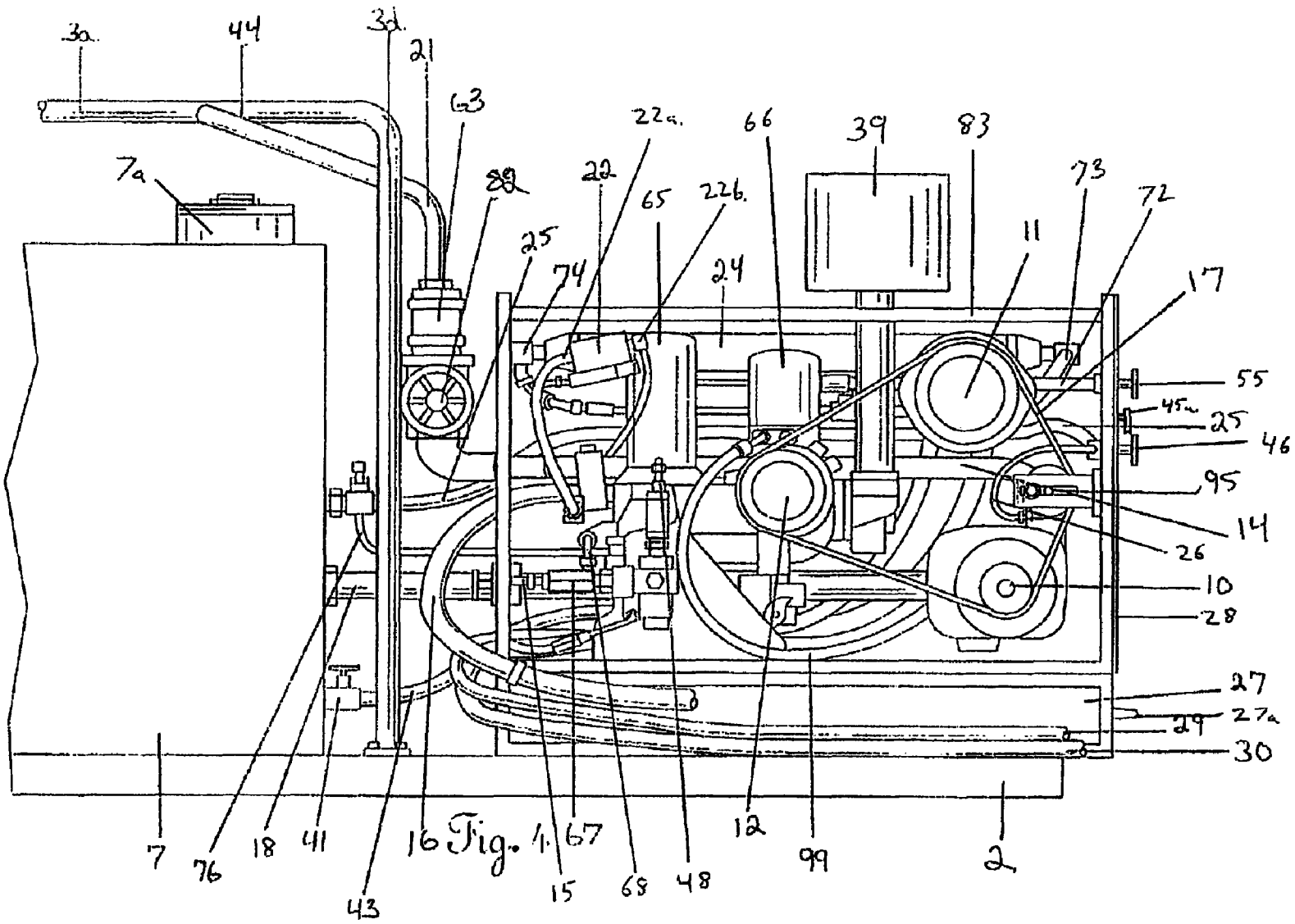

FIG. 3 is a detailed topdown view of the system including the CAFS unit 5 and its various components. The CAFS unit 5 is contained within a steel frame 83 which is bolted onto the aluminum skid support platform 2.

The self-contained system contains the foam proportioner 13, water pump 10, hydraulic motor 11 and air compressor 12. The water pump 10 suctions water from the water tank 7 through a fixed pump intake pipe 18. Pump intake pipe 18 emerges near the bottom center of the water tank 7, makes a 90° turn towards the passenger side of host 1, then makes another 90° turn and runs toward the rear of host 1. The pump intake pipe 18 runs to the passenger side of water pump 10 which is located at the bottom driver's side of CAFS unit 5. Water from the tank flows through the pump intake pipe 18 to the water pump 10 and discharges through the pump discharge pipe 14 located on the top of the water pump 10 and attached to the control panel 28 by a U" bracket (not shown). The pump discharge pipe 14 extends perpendicular up out of the water pump 1 0 before turning toward the passenger-side of the host vehicle 1 at a 90° angle. The pump discharge pipe 14 continues briefly before turning 90° toward the front of the host 1. The section of pump discharge pipe 14 between the 90° turns noted above 87 is welded to the curved elbow shaped turn sections. Connected horizontally to the side of pipe 87 is a "T" junction that is connected to auxiliary tank fill hose 26. Auxiliary tank fill hose begins on the control panel 28, and extends through the control panel 28, and enters valve assembly 45. The jet primer valve 32 (shown on FIG. 5) is utilized to help create a suction that draws water from the outside source into the auxiliary tank fill hose 26. When tank fill valve 45*a* is turned, it controls the valve 45 which either allows water to continue through auxiliary tank fill hose 26 or enter tank fill line 25. Auxiliary tank fill hose 26 may be connected to a secondary source of water such as a pond through use of an external hose connected to the auxiliary tank fill hose 26. The suction created by the water pump allows water to flow through auxiliary tank fill hose 26, and depending on how the valve 45*a* is turned, it can either be pulled through the auxiliary tank fill line 26, through the "T" junction 87 and into pump discharge pipe 14, pulled into the auxiliary tank fill hose 26, into the valve assembly 45, through tank fill hose 25, and finally deposited in the water tank 7.

A brass "T" junction 90 is connected to the pump discharge pipe 14 immediately after the pump discharge pipe 14 makes the 90° turn towards the front of the host 1. The brass "T" junction 90 has a section perpendicular to the horizontal piping attached to the pump discharge pipe 14. Inserted into the perpendicular section of "T" junction 90 is a paddlewheel flowmeter 91 to which an electrical line is attached leading to the foam proportioner 13. The purpose of flowmeter 91 is to measure the water flow and send a signal to the motor driver control of the foam proportioner 13 thereby controlling foam output.

Pump discharge pipe 14 continues through the "T" junction 90 where it is connected to "T" junction 19. Pump discharge pipe 14 continues thru "T" junction 19, while the perpendicular portion of "T" junction 19 lies horizontally facing the passenger side of host 1 and is further connected to an elbow shaped pump-to-hose discharge pipe 94 that makes a 90° turn towards the front of host 1. Pump-to-hose discharge pipe 94 continues briefly before making a 90° turn down approximately 6" and then turning 90° toward the driver's side of host 1. Attached to pump-to-hose discharge pipe 94 via clamp is the flexible hose reel discharge line 16 which leads to hose reel 6*a* and forestry hose 6*b*. Air discharge line 68 enters pump-to-hose discharge line 94 through brass inlet 78 (shown on FIG. 6) providing air to pressurize the mixture. Prior to the 90 degree downward turn of pump-to-hose discharge pipe 94 is the hose reel water valve 71 that, when opened, allows water to flow to the hose reel discharge line 16. A push/pull rod 72 connects to hose reel water valve and extends the length of CAFS unit 5 to control panel 28 located on the rear of the CAFS unit 5. The push/pull rod 72 consists of two rods connected by a uniflex joint and is opened when the hose reel water handle 55, located on the control panel 28, is pulled.

Inserted into the top of "T" junction 19 is a foam injector port 20. The foam injector port 20 is connected to a hose with a I-way check valve leading from the CAFS unit 5. Pump discharge pipe 14 continues through "T" junction 19 via a 1½" pipe outlet and continues toward the front of the host vehicle 1, exiting the metal frame 83 where the pump discharge line makes a 90° turn vertically where it is connected to a manual gate valve 82 which opens/closes pump discharge pipe 14. Immediately past the manual gate valve 82, pump discharge pipe 14 continues briefly where it is then screwed into electric motor valve 63 which opens/closes the valve based on input from the trigger switch control within the cab of host 1. The electric motor valve 63 allows the water, foam or water/foam mixture to continue through pump discharge line 14 on to flexible water/foam hose 21 which continues straight up before making a 45° turn to the front of the host 1 and connecting via clamp to the horizontal section of support conduit 3*a*, which leads to remote control nozzle 4. Inlet 79 is where the flexible air discharge hose 15 joins pump discharge pipe 14 immediately past electric motor valve 63. A rigid manual shut off valve 15*a* connects the flexible air discharge hose 15 with inlet 79. The air discharge hose 15 originates on the bottom end of the air compressor 12 and provides air pressure to the water/foam mixture exiting the unit through the adjustable remote control nozzle 4.

The water line 76 (shown on FIG. 6) starts from the heat exchanger 24 and returns back into the water pump 10 via an inlet into the tank fill line 25 near the water tank 7. The oil line 73 travels from the air compressor 12 into the heat exchanger from the rear of host 1 for cooling from the air compressor 12 then exits at the opposite end of the heat exchanger near the water tank 7 as oil line 74, returning the cooled oil to an inlet on the air compressor. The foam drain line 77 exits on the passenger side of CAFS unit 5. The compressor warning light 53 (shown on FIG. 4) is connected to the flexible compressor warning line 53*a*.

FIG. 4 is a view of the CAFS unit 5 from the driver's side of Host 1 with the hose reel 6 removed to increase the viewable area. Extending up over the CAFS unit 5 is the air intake with filter 39 which provides filtered air to the air compressor unit 12. Also shown are the oil filter 65 and air separator 66, both attached to the top portion of the air compressor unit 12. The flexible hydraulic hose 29, which is connected to the host hydraulic hookup 57 (shown on FIG. 1), provides hydraulic fluid under pressure to the hydraulic motor 11, shown at the driver's side rear of the host unit 1 above the water pump 10. The flexible hydraulic return hose 30 exits the hydraulic motor and returns to the host vehicle 1 through connection at the host hydraulic hookup 57 at the drivers side rear of the host unit 1. The auxiliary hydraulic return line 40 (shown on FIG. 1) is connected to both the hydraulic return line 30 and the host hydraulic hookup 57. The hydraulic fluid travels from the host hydraulic hookup 57 through the hydraulic line 29 to the hydraulic motor 11. Pressure from the hydraulic fluid provided through the hydraulic line 29 turns the hydraulic motor at approximately 3800 rpm's. This force is used to rotate the serpentine belt 17 which powers the air compressor 12 and the water pump 10. Towards the rear of the CAFS unit and bracketed to the steel support 83 of the CAFS unit 5 is the serpentine belt tensioner 95 which moves a gear forward and back on a railing with a screw to hold the gear in place, thereby allowing the notched serpentine belt 17 to be tightened or loosened as needed. At the bottom of the CAFS unit 5 and integrated as part of the skid platform support 2 is the hand tool equipment box 27 which slides open to the rear of the system immediately under the control panel 28. Immediately below the equipment box 27 is the aluminum skid support platform 2.

The main air discharge valve 48 is located immediately next to air compressor 12 on the driver's side and supplies air to main air discharge pipe 67. From main air discharge pipe 67 the air travels to air discharge hoses 15 and 68. Air discharge hose 15 leads to pump discharge pipe 14 via inlet 79, and air discharge pipe 68 leads to hose reel 16 via inlet 78. To aid in better foam production, a pressure balancer 22 is connected between air compressor 12 via line 22*c* (not shown) and balancing lines 22*a* and line 22*b*. Line 22*a* measures the water pressure psi coming from the pump discharge line 14 through a valve located on pipe 87 (not shown). Line 22*b* leads to the fixed/auto air control coupling 51*a* (shown on FIG. 3) which attaches to fixed/auto air control 51 located on control panel 28 (shown on FIG. 5), and when activated, allows the balancer 22 to balance the pressure from the water discharge pipe 14 and the main air valve 48 through line 22*c* (not shown). The equalization of air pressure from the air compressor and water pressure ensures better foam production. The auxiliary discharge air supply originates from the air compressor 12 and travels through a flexible hose 99 that connects to the auxiliary air discharge valve 31 and subsequently to the auxiliary air discharge 47 located on the control panel of the CAFS unit 5 (shown on FIG. 6).

Immediately posterior to water tank 7 is the auxiliary tank fill line 25 with the water line 76 returning water from the heat exchanger 24 back to the water tank thru an inlet into the auxiliary tank fill line 25. The pump intake pipe 18 is located lower on the water tank 7 than the auxiliary tank fill line 25 is.

Figure 5:
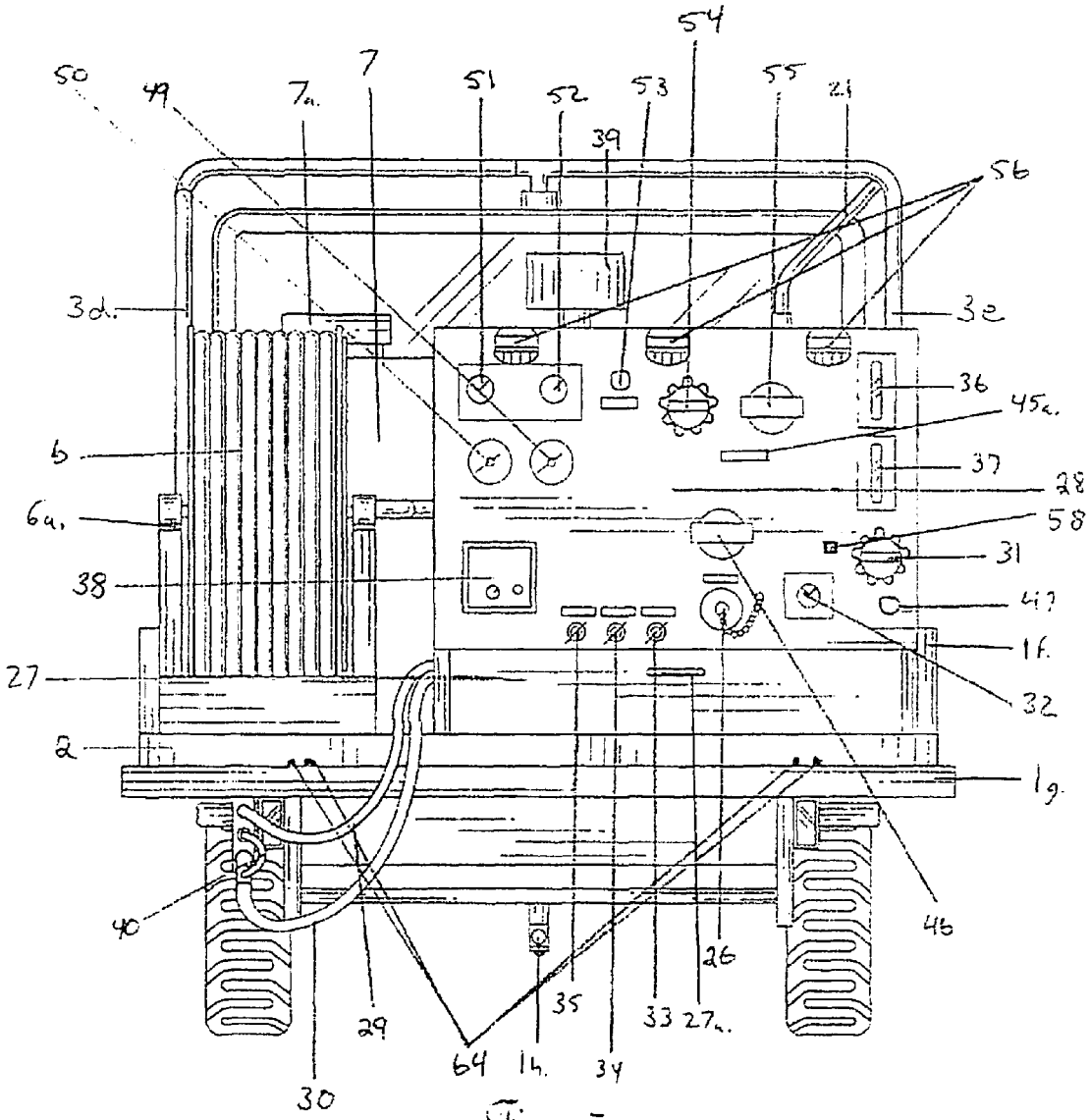
FIG. 5 illustrates, from the rear view of the host, the CAFS module and controls, the hose reel and the host hydraulic lines which power the CAFS module's hydraulic motor.

Referring to FIG. 5, this is a view from the rear of the CAFS unit 5 and host 1. Indicated on the drawing is the control panel 28 into which holes have been drilled for various gauges, switches, inlets, and ports. Beginning on the driver side, on top of panel 28 is the fixed air auto switch 51, and immediately next to it is run/unload air fixed pump control 52. Along the upper edge of panel 28 are 3 fixed panel lights 56 controlled by the panel light switch 58. Immediately underneath the fixed air auto switch 51 is the master water pressure gauge 50, and immediately underneath the run/unload air fixed pump control 52 is the master air pressure gauge 49. Below these 2 gauges is the foam proportioner % value control 38, which allows the foam to be turned on/off as well as controlling the foam output to between 0.01% and 1%. The compressor warning light 53 is to the immediate passenger side of the run/unload air fixed pump control 51. The hose reel air switch 54 is near the center/top of the control panel 28 and is operated by turning the knob counter-clockwise to open. To the immediate passenger side of the hose reel air switch 54 is the hose reel water handle 55, which operates via pulling to allow water to the hose reel 16 and pushing to stop the flow of water. Along the far upper passenger side corner of the control panel 28 is the LED water level indicator 36, and immediately below it the LED foam level indicator 37. Towards the bottom passenger side corner of panel 28 is the auxiliary air valve 31 and an auxiliary air discharge port 47. The tank to pump handle 46 is located in the middle of the control panel 28 and is pushed to activate and pulled to close; it operates the main intake pipe to allow water to flow from water tank 7 to water pump 10. Immediately below is the auxiliary tank fill 26 is a 1½" pipe to the tank, capped with brass cap chained to the unit. To the immediate passenger side of foam proportioner % value control 38 are three drain valves listed from driver side to passenger side: cooler drain valve 35, manifold drain valve 33 and pump drain valve 34. Also on control panel 28 is the jet primer valve 32 used to pull water into the pump for refilling or for spraying, and it is located in between the auxiliary discharge port 47 and the auxiliary tank fill 26.

The auxiliary discharge port 47 can be used with proper attachments to power tools that require compressed air such as rescue and impact tools. The system is controlled through shutting off water discharge through manual gate valve 82 or electronic motor valve 63 and hose-to-reel valve 55. Water is still able to run through the heat exchanger to cool the system down and returns to the water tank via water line 76.

Immediately below the control panel 28 and extending underneath CAFS unit 5, a tool drawer 27 with handle 27*a* is attached to skid platform 2. Four bolts 64 affixing the skid support platform 2 to the bed of host 1 are screwed into the back rear of the host vehicle 1.

Figure 6:
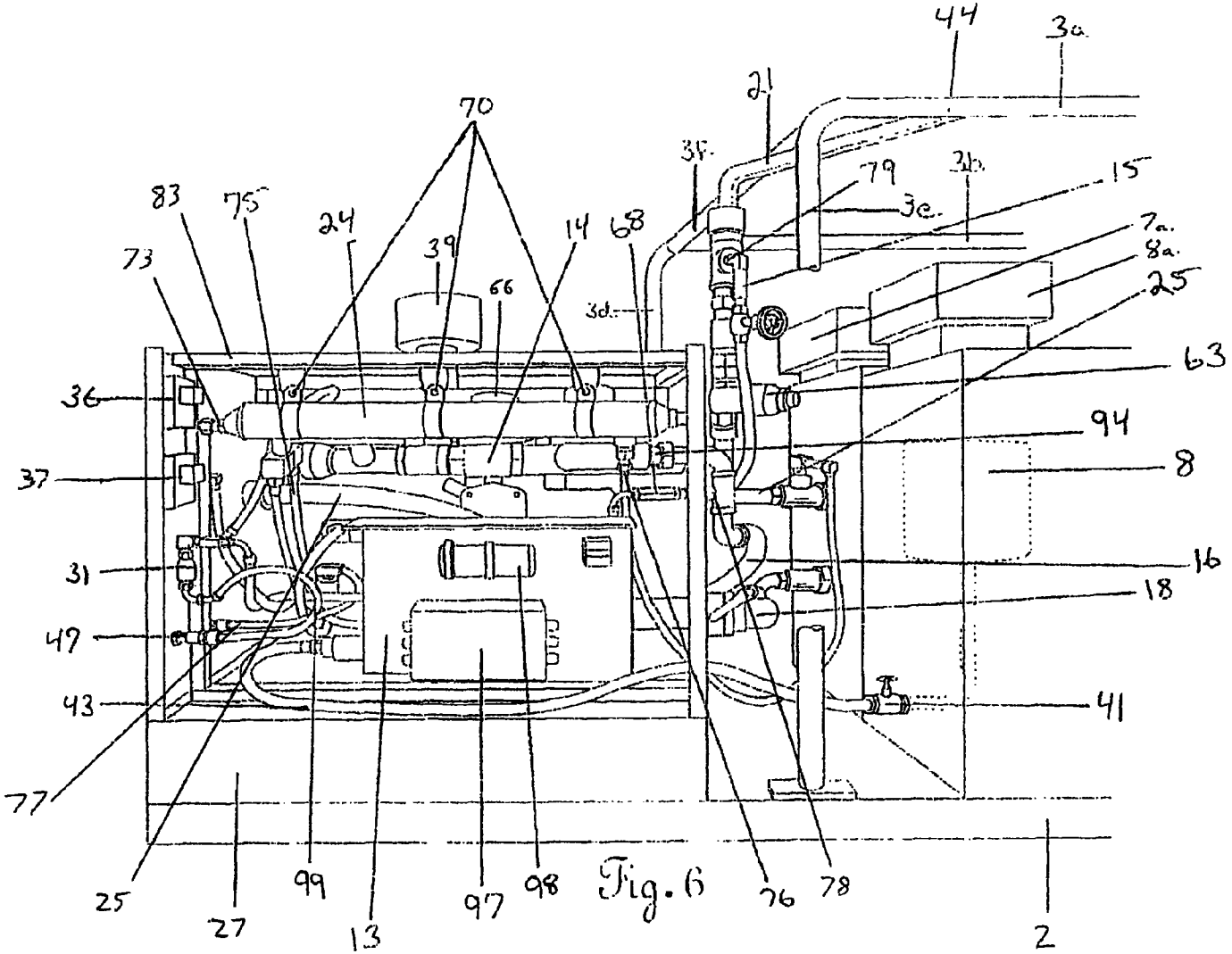
FIG. 6 illustrates the passenger side view of the CAFS module and the connections between the CAFS module and the system's water tank and foam tank.

Looking at FIG. 6, the foam proportioner unit 13, secured to the passenger side of the CAFS unit 5, suctions foam from the foam tank 8 through a clear tube 43. The CAFS unit 5 uses a proportioner 13 that is mounted on the skid platform 2 and is used to control the water to foam ratio. By adjusting the proportioner 13, the operator can optimize the amount of water used to create the foam spray that is used to put out fires. Visible on the foam proportioner unit 13 are the electronics for the proportioner 97 and the foam proportioner capacitor 98, both secured to the foam proportioner 13 itself. The foam from the tank 8 passes through a valve 41 with strainer immediately proximal to the foam tank 8 with poly tube 43 attached to said valve via NST connection.

The heat exchanger 24 is attached to the top passenger side of the CAFS unit 5 where it receives oil from the air compressor 12 via oil line 73 and cools it prior to the oil being returned to the air compressor 12 via oil line 74 (shown on FIG. 4). There are three brackets 70 used to attach the heat exchanger to the top of CAFS unit 5. A water hose 75 is the water input into the heat exchanger 24 directly from the water pump 10. Hose 76 emerges from the heat exchanger 24 at the opposite end of the input hose 75 and returns the water to the water tank 7 via an inlet located on tank fill hose 25 just prior to its entrance into water tank 7. Connected to the assembly along with input hose 75 is a drain hose 77 that allows water to drain from the system and exit through drain valve 33.

Hose 99 connects auxiliary air input 47 to auxiliary air valve 31. Immediately posterior to where water conduit 21 intersects and is welded to rigid water supply conduit and support 3*a* is a metal cap preventing backflow 44 of water through the rigid water supply conduit and support 3*a*.

The system operates as follows. The system is wholly powered by the hydraulic system of the host vehicle powering a hydraulic motor on the system. The system hydraulic motor turns a serpentine belt at sufficient RPM's to power a liquid pump, air compressor and the Compressed Air Foam System (CAFS) module. Using solely the power provided by the hydraulic motor, water or other liquid is drawn from the tank, either used alone or mixed with foam at the percentage inputted by the user. Compressed air is added and the air alone, liquid alone or water/foam mixture is routed via adjustable valve to either the 1 inch forestry hose or the rigid waterway ending in an adjustable, movable nozzle attached to the cab roof of the host. The system could also be used to spray chemicals such as insecticides, herbicides, fungicides, algaecides, fertilizers or other liquid solution. The typical liquid is water but other suitable liquids might be used. The type of spray can also be varied and controlled by the type of nozzle used.

The system can be easily removed from the vehicle by removing stainless steel bolts 64 attaching the skid support platform 2 to the host vehicle's bed 1. Additionally, there is a metal lip 84 bolted to the bed of the host vehicle immediately behind the drivers compartment. The skid support platform 2 of the system fits under this lip in addition to being bolted to the host vehicle. The hydraulic tubing 29 and 30 must also be disconnected from the hydraulic hookup 57 of the host vehicle. Due to the weight of the system, a forklift or hoist may be required to remove it from the host vehicle. However, after removal, the system may be quickly placed onto another host and bolted to the bed, the hydraulic lines must hooked up, and the system is ready for use.

Before concluding, it is to be understood that the terminology employed in this application is for the purpose of describing particular embodiments. Unless the context clearly demonstrates otherwise, it is not intended to be limiting. In this specification and the appended claims, the singular forms "a," "an" and "the" include plural references unless the context clearly dictates otherwise. Conversely, it is contemplated that the claims may be drafted to exclude any optional element or be further limited using exclusive terminology as "solely," "only" and the like in connection with the recitation of claim elements or by use of a "negative" limitation. It is also contemplated that any optional feature of the inventive variations described herein may be set forth and claimed independently, or in combination with any one or more of the features described herein.

Although the foregoing specific details describe various embodiments of the invention, persons reasonably skilled in the art will recognize that various changes may be made in the details of the apparatus of this invention without departing from the spirit and scope of the invention as defined in the appended claims. Therefore, it should be understood that, unless otherwise specified, this invention is not to be limited to the specific details shown and described herein.

I claim:

1. A compact, self-contained, rapidly mountable and dismountable system with a compressed air foam system unit for rapid mounting and dismounting on a rear bed of a multiple purpose compact host vehicle that has hydraulic fluid hookups to provide hydraulic fluid to the system comprising:

a skid mountable platform configured to enable the system, including the platform itself, to be mounted on, or dismounted from, the rear bed of a multiple purpose compact host vehicle using a forklift or hoist;

a liquid reservoir and a foaming agent reservoir mounted on the platform;

means for connecting said reservoirs to a motor driven pump mounted on the platform and driven by a motor mounted on the platform;

a foam generator connected to said pump;

a remotely operated nozzle connected to the pump and mounted on a support extending from the platform to direct a spray away from the multiple purpose compact host vehicle for selectively delivering foam or liquid to a desired location away from the multiple purpose compact host vehicle; and a remote control device for mounting for access by an operator within the cab of the multiple purpose compact host vehicle for controlling and operating the remotely operated nozzle to selectively direct the remotely operated nozzle to a desired location away from the vehicle to output foam or liquid;

wherein the compact, self-contained, rapidly mountable and dismountable system is powered by hydraulic fluid under pressure from the compact host vehicle.

2. The compact, self-contained, rapidly mountable and dismountable system as claimed in claim 1 wherein:

a foaming agent reservoir is mounted in the liquid reservoir.

3. The compact, self-contained, rapidly mountable and dismountable system as claimed in claim 1 further comprising:

a manual hose reel with manual on/off control mounted on the system and connected to the pump for manually delivering foam or water via the hose nozzle.

4. The compact, self-contained, rapidly mountable and dismountable system as claimed in claim 1 wherein:

the compact self contained removable system is powered by the compact host vehicle.

5. The compact, self-contained, rapidly mountable and dismountable system as claimed in claim 1 wherein the remote control device comprises:

indicators and controls that allow an operator to monitor and control the compact, self-contained, rapidly mountable and dismountable system from within the compact host vehicle.

6. The compact, self-contained, rapidly mountable and dismountable system as claimed in claim 1 further comprising:

valves and controls for allowing the operator to choose between a pure liquid and a liquid/foam mixture to be delivered though the nozzle.

7. The compact, self-contained, rapidly mountable and dismountable system as claimed in claim 1 wherein:

said compact, self-contained, rapidly mountable and dismountable system contains a control to allow the operator to choose between directing the foam or liquid to the remotely operated nozzle or the manually operated firefighting hose.

8. The compact, self-contained, rapidly mountable and dismountable system as claimed in claim 1 wherein:

a compact, self-contained, rapidly mountable and dismountable system is mounted on a skid mountable support platform so that it can be readily releasably mounted on and removed from the compact host vehicle when it is desired to use the compact host vehicle for different functions.

9. A method of removable mounting and operating a compact, self-contained, removable system with a compressed air foam system unit on the rear of a multiple purpose compact host vehicle comprising the steps of:

using a hoist or forklift to connect a self contained skid mountable platform including a compressed air foam system on the rear bed of a multiple purpose compact host vehicle;

connecting the compact, self-contained, removable system to the power system of the compact host vehicle to provide power to the compact, self-contained, removable system so the compact, self-contained, removable system is powered by the compact host vehicle;

operating a remote control device for mounting for access by an operator within the cab of the multiple purpose compact host vehicle to control and operate a remotely operated nozzle to selectively direct the remotely operated nozzle to a desired location away from the vehicle to output foam or liquid; and powering the compact, self-contained, removable system by hydraulic fluid under pressure from the compact host vehicle.

10. The method of claim 9, further comprising the step of: monitoring and controlling the compact, self-contained, removable system within the compact host vehicle.

11. The method of claim 9, further comprising the steps of: controlling the compact, self-contained, removable system to allow an operator to choose between directing a water/foam/air mixture to the remotely operated nozzle or the manually operated firefighting hose.

12. The method of claim 9, further comprising the step of: removing the compact, self-contained, removable system mounted on the skid support platform from the compact host vehicle when it is desired to use the compact host vehicle for different functions.

13. The compact, self-contained, rapidly mountable and dismountable system of claim 1, wherein the host vehicle has a chassis frame and the skid platform is separate and distinct from the chassis frame of the host vehicle.

14. The compact, self-contained, rapidly mountable and dismountable system of claim 1, wherein the skid mountable platform does not support the cab of the host vehicle.

15. The compact, self-contained, rapidly mountable and dismountable system of claim 1, further comprising quick-connect couplings to connect hoses between the compact host vehicle and the compact, self-contained, rapidly mountable and dismountable system, in order to use the host vehicle's hydraulic fluid power source to power the compact, self-contained, rapidly mountable and dismountable system.

16. A compact firefighting foam-and-liquid delivery system operable to be rapidly mounted to and dismounted from a driver-operated compact host vehicle that has a frame, a driver's cab, a rear section behind the driver's cab, a hydraulically-operated articulating front-end accessory, and hydraulic fluid hookups to provide hydraulic fluid to additional mounted accessories, the system comprising:

a skid mountable platform, distinct from and not integral with the frame of the host vehicle, operable to be removably mounted on the rear section of the host vehicle;

a nozzle for directing a spray of liquid or foam;

one or more tanks for holding liquid or foam mounted on the platform;

a liquid pump mounted on the platform for directing liquid or foam through the nozzle;

an air compressor for directing compressed air into the liquid or foam mixture;

a hydraulic motor, operable to be driven by hydraulic fluid circulated by the host vehicle, mounted on the platform for driving the pump and the air compressor;

wherein the liquid pump and air compressor are driven by the hydraulic motor.

17. The compact firefighting foam-and-liquid delivery system of claim 16, wherein the host vehicle's hydraulically-operated articulating front-end accessory is a bucket.

18. The compact firefighting foam-and-liquid delivery system of claim 16, further comprising quick-connect couplings to connect the hydraulic fluid hoses to the host's hydraulic fluid hookups.

19. The compact-firefighting foam-and-liquid delivery system of claim 16, further comprising a remote-control nozzle configured to be mounted over the driver's cab of the host vehicle.

* * * * *